US005284382A

United States Patent [19]

Klumpjan

[11] Patent Number: 5,284,382

[45] Date of Patent: Feb. 8, 1994

[54] BROOM MAKING APPARATUS

[76] Inventor: Joe Klumpjan, 1334 Sunset Dr., Rte. 3, Campbellsport, Wis. 53010

[21] Appl. No.: 47,147

[22] Filed: Apr. 13, 1993

[51] Int. Cl.[5] ..... A46D 7/00

[52] U.S. Cl. ..... 300/12

[58] Field of Search ..... 300/12, 14, 15

[56] References Cited

U.S. PATENT DOCUMENTS

| | | | |
|---|---|---|---|
| Re. 2,495 | 2/1867 | Day | 300/12 |
| 6,717 | 9/1849 | Thomas | 300/12 |
| 59,977 | 11/1866 | Day | 300/12 |
| 69,780 | 10/1867 | Day | 300/12 |
| 157,614 | 12/1874 | Lannay | 300/12 |
| 1,549,769 | 8/1925 | Hollensbe et al. | 300/12 |
| 1,765,769 | 6/1930 | Mueller | 300/15 |

FOREIGN PATENT DOCUMENTS

| | | | |
|---|---|---|---|
| 354769 | 12/1937 | Italy | 300/12 |

*Primary Examiner*—Mark Rosenbaum
*Assistant Examiner*—Frances Chin
*Attorney, Agent, or Firm*—Andrus, Sceales, Starke & Sawall

[57] ABSTRACT

An apparatus for making a brush broom includes a lever-operated holder for enclosing and precompressing the gathered cut ends of a bunch of branches for a broom. The lever is pressed downwardly against the enclosed branch ends and held by the user until a U-shaped tie wire surrounding the branches and extending upwardly through a slot in the lever arm is twisted around the branches. The broom handle is driven into the center of the bound branch ends to complete the broom.

2 Claims, 2 Drawing Sheets

BROOM MAKING APPARATUS

BACKGROUND OF THE INVENTION

The present invention pertains to the manufacture of brooms and, more particularly, to an apparatus useful in making a brush broom.

Brush brooms of the type made by attaching the cut ends of a gathered bunch of branches to the end of a broom handle are very old and well known in the art. Although such brooms are not as common today, due to the advent of straw brooms and brooms made with synthetic bristles, brush brooms are still known to be effective and very efficient to use. The branches used may be from any tree or bush that provides a very twiggy branch which when gathered in the broom, provides a flared sweeping end with densely packed twig ends. The most important aspect in making such a broom is providing a tight and permanent attachment of the cut ends of the branches which are eventually attached to the end of the broom handle.

SUMMARY OF THE INVENTION

In accordance with the present invention, a broom making apparatus includes means for tightly compressing the gathered cut ends of branches prior to applying one or more wire ties so that the ties can be applied manually to a snug condition while the ends of the bunch of branches are tightly compressed so that when the compression is released, the re-expansion of the branches tensions the ties tightly.

The apparatus includes a base plate adapted to lie flat on a supporting surface. An upwardly opening U-shaped holder is attached to the base plate and has a widened U-shaped surface. A continuous narrow groove is formed in the U-shaped surface and is dimensioned to receive a U-shaped tie wire having legs which extend upwardly beyond the upper ends of the holder. A lever arm is hingedly attached at one end to the base plate with the hinge pivot axis parallel to the U-shaped surface. The lever arm is adapted to pivot downwardly to an operative position along and generally parallel to the base plate and to overlie the U-shaped holder. A forming block is attached to the lever arm in a position in which it faces downwardly in the operative position. The forming block includes a semicylindrical forming surface which is disposed to open downwardly when the lever arm is in the operative position. The forming block and lever arm are provided with a common open slot which extends therethrough to divide the forming surface into two surface halves. The upper ends of the U-shaped holder and the ends of the legs of the tie wire pass through the open slot and, simultaneously, the forming surface halves straddle the holder when the lever is pivoted to the operative position. The cut ends of the bunch of branches are gathered and laid across the U-shaped surface and within the U-shaped tie wire. The ends of the bunch are compressed between the U-shaped surface and the forming surface when the lever arm is pivoted to the operative position. With the ends of the branches so compressed, the upper ends of the tie wire are twisted together around the branch ends within the slot to secure the compressed branch ends. The broom handle end, provided with an appropriate taper, is then driven into the tied branch ends inside the wire ties. In the preferred embodiment, the slot opening in the upper surface of the lever arm, when in the operative position, includes an enlarged opening which has a downwardly convergent surface to facilitate grasping and twisting the ends of the tie wire, as with a pliers or the like.

DETAILED DESCRIPTION OF THE PREFERRED EMBODIMENT

Figure 1:
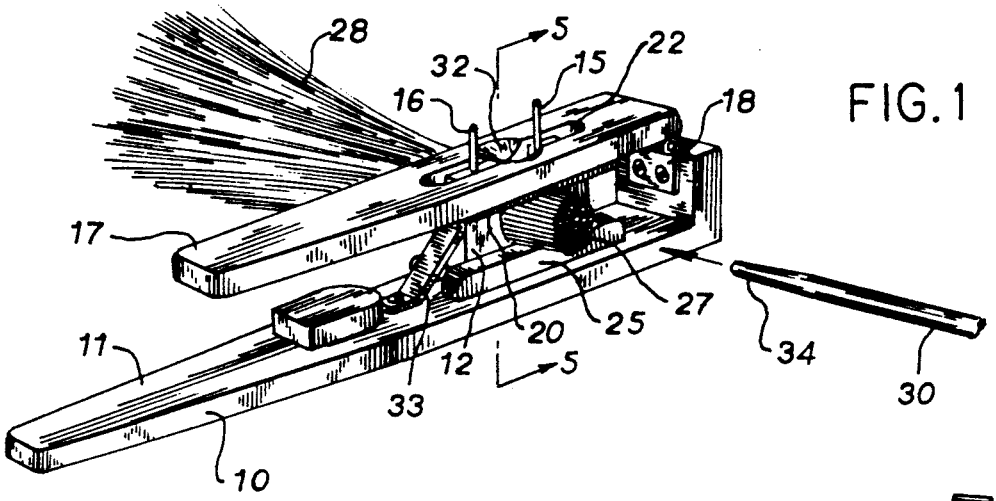
FIG. 1 is a perspective view of the apparatus of the present invention showing the gathered cut ends of a bunch of branches compressed therein.

The apparatus of the present invention includes a generally elongate base plate 10 which is adapted to lay on a flat supporting surface 11, such as a floor. A U-shaped holder is attached to the base plate 10 and includes an upwardly opening U-shaped surface 13. A continuous narrow groove 14 is formed in the surface 13 and is adapted to receive therein a U-shaped tie wire 15 having legs 16 substantially longer than the corresponding legs of the groove 14, so that the wire legs 16 extend upwardly beyond the upper ends of the holder 12, as may best be seen in FIG. 1.

Figure 2:
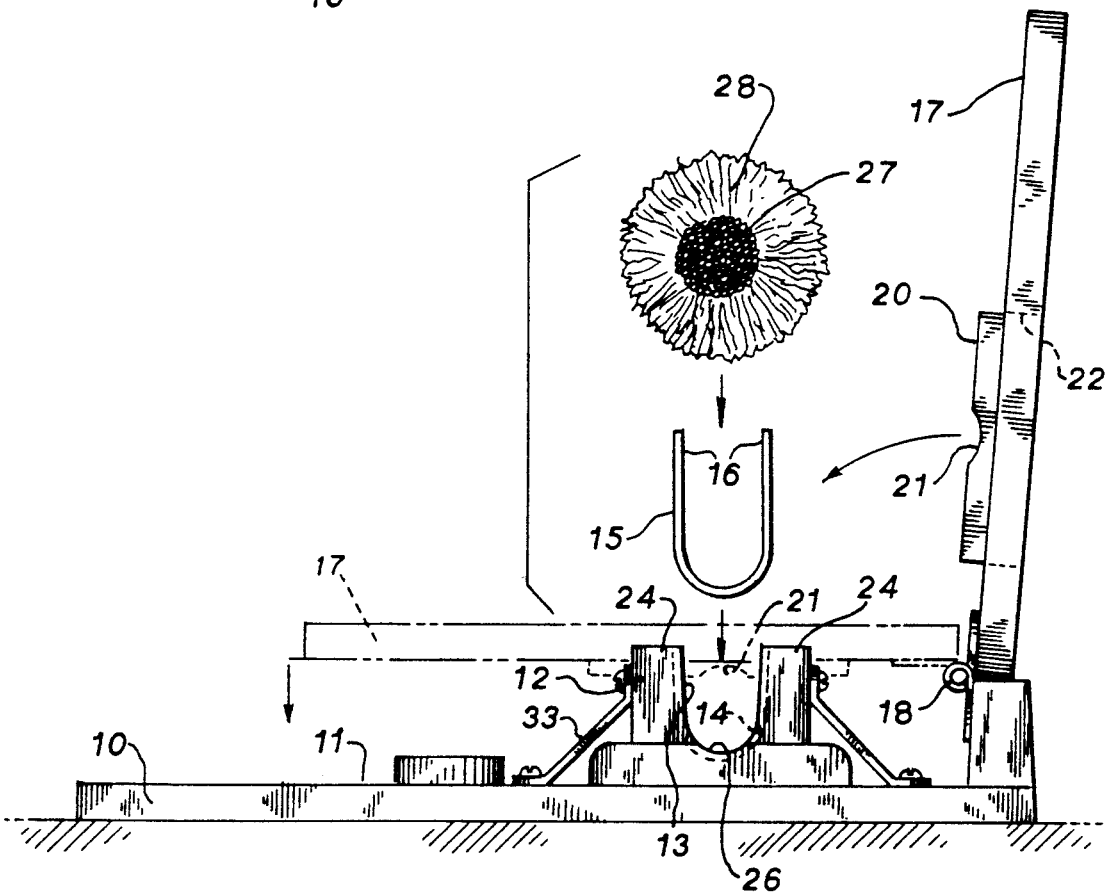
FIG. 2 is an exploded side elevation view of the apparatus of the present invention and the components used therewith to make the brush for a broom.
Figure 3:
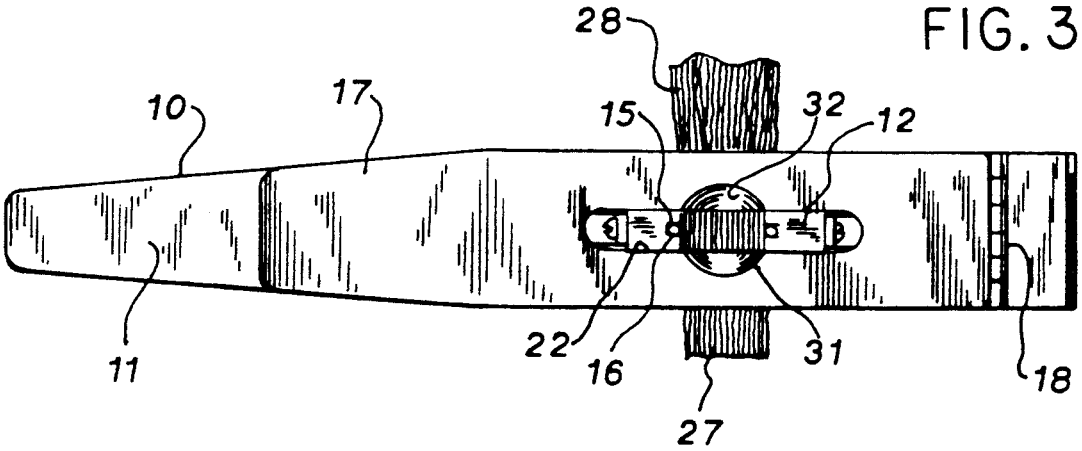
FIG. 3 is a top plan view of the device shown in FIG. 1.

A lever arm 17 is attached by one end to an end of the base plate 10 with a hinge 18. The pivot axis of the hinge lies parallel to the U-shaped surface 13 of the holder such that the lever arm may pivot downwardly from its generally vertical open position shown in FIG. 2 to an operative position along and generally parallel to the base plate (as shown in FIG. 1 and in phantom in FIG. 2) to overlie the U-shaped holder 12. A forming block 20 is attached to one face of the lever arm 17 so that the block faces downwardly in the operative position of the lever arm. The forming block includes a semicylindrical forming surface 21 which also faces downwardly over the U-shaped holder 12 in the operative position of the lever arm. An elongate open slot 22 extends completely through the forming block 20 and the lever arm 17 to divide the block and the forming surface into two surface halves 23. The slot 22 is dimensioned to receive the upper ends 24 of the holder 12 and the ends of the legs 16 of the tie wire when the lever arm is pivoted to the operative position. Simultaneously, the forming surface halves 23 straddle the upper ends 24 of the U-shaped holder 12 as the lever arm 17 is pivoted downwardly to the operative position.

A pair of supplemental supports 25 are attached to the upper surface of the base plate 10 on opposite sides of the U-shaped holder 12. The supplemental supports each have a semicylindrical lower supporting surface 26, which surfaces conform to the bottom of the U-shaped surface 13 in the holder. The lower supporting surfaces 26 effectively extend the U-shaped surface 13 to provide support at a position downwardly opposite the upper forming surface halves 23.

In operation, the cut ends 27 of a bunch of branches 28 are gathered into a generally cylindrical bundle and laid in the U-shaped holder 12, into which a tie wire 15 has been previously inserted and held in position in the groove 14. The lever arm 17 is then pivoted downwardly over the holder and branch ends 27 to compress the branch ends between the lower common surfaces 13 and 26 and the upper forming surface halves 23. Tight compression of the branch ends 28 is facilitated by the knee of the user being pressed onto the end of the lever arm remote from the hinge 18. While the branch ends 27 are held in compression, the ends of the tie wire legs 16 extending through the open slot 22 and above the upper surface of the lever arm 17 are bent to cross one another and then twisted to secure the compressed branch ends together, as by grasping the tie wire ends between the jaws of a pliers or the like.

To allow the nose of a pliers to be inserted into the slot 22 to grasp the tie wire legs 16 as close to the branch ends as possible, the slot opening in the upper surface of the lever arm is provided with an enlarged opening 31, which opening is preferably tapered to provide a downwardly convergent surface 32 through the lever arm. A convergent surface 32, such as one of conical shape, is preferred to a cylindrical hole which might cut into the halves 23 of the forming surface 21.

Figure 4:
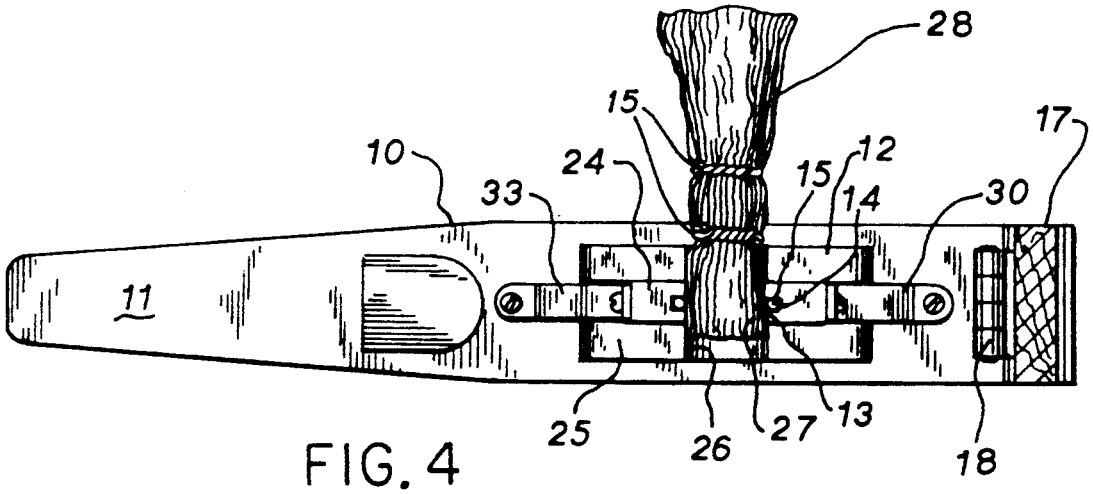
FIG. 4 is a top plan view, partly in section, of the apparatus in the FIG. 2 position.
Figure 5:
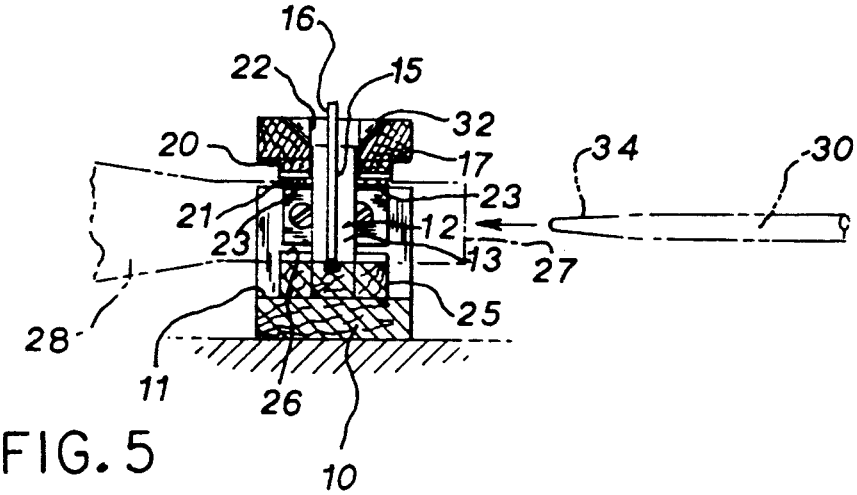
FIG. 5 is sectional view taken on line 5—5 of FIG. 1.

Referring particularly to FIG. 4, the wire tying process may be repeated one or more times at spaced intervals along the bunched branch ends 27 to provide multiple tie wires 15. The opposite sides of the holder 12 along the base plate 10 may be strengthened with a pair of gussets 33 against the compressive force imposed by the lever arm.

Although it is possible to gather the cut ends 27 of the branches around the end of a broom handle 30 and lay the combination of the broom handle end surrounded by the branch ends in the U-shaped holder 12, it is preferable to tie the branches with multiple tie wires 15 separately from the broom handle. After the bunch of branches 28 has been securely tied, it is removed from the apparatus and the broom handle 30, provided with a suitably tapered end 34, is driven into the center of the secured cut ends 27. The tapered end 34 is preferably driven at least as far as the furthest tie wire 15 and, after it is in place, it may be staked with an ordinary nail driven through the gathered branch ends 27 and perpendicularly into the handle 30. This helps prevent both withdrawal and rotation of the handle.

Various modes of carrying out the present invention are contemplated as being within the scope of the following claims particularly pointing out and distinctly claiming the subject matter which is regarded as the invention.

I claim:

1. A broom making apparatus for securing the gathered cut ends of a bunch of branches together to form the brush portion of a broom, said device comprising:

a base plate adapted to lie flat on a supporting surface;

an upwardly opening U-shaped holder attached to the base plate and having a U-shaped surface;

a continuous groove formed in said U-shaped surface and dimensioned to receive therein a U-shaped tie wire having legs extending upwardly beyond upper ends of the U-shaped holder;

a lever arm hingedly attached at one end to the base plate with a hinge pivot axis parallel to said U-shaped surface, said lever arm adapted to pivot downwardly to an operative position along and generally parallel to the base plate and to overlie the U-shaped holder;

a forming block attached to the lever arm to face downwardly in the operative position, said forming block having a semicylindrical forming surface disposed to open downwardly in said operative position;

an open slot extending through the forming block and lever arm to divide the forming surface in two surface halves, such that the upper ends of the U-shaped holder and upper ends of a tie wire pass through said open slot, and the forming surface halves straddle said holder, when the lever arm is pivoted to the operative position;

whereby the gathered cut ends of the bunch of branches are laid across the U-shaped surface and within the U-shaped tie wire, the lever arm pivoted to the operative position to compress the ends of the branches between the U-shaped surface and the forming surface, and the upper ends of the tie wire twisted together within said slot to secure the compressed branch ends around the handle.

2. The apparatus as set forth in claim 1 wherein said open slot in an upper surface of the lever arm in the operative position includes an enlarged opening having a downwardly convergent surface to facilitate grasping the ends of the tie wire.

* * * * *